US005626484A

United States Patent [19]

Okuyama et al.

[11] Patent Number: 5,626,484

[45] Date of Patent: May 6, 1997

[54] CONNECTOR EMPLOYING LIQUID CONDUCTOR FOR ELECTRICAL CONTACT

[75] Inventors: Takeshi Okuyama; Kouji Watanabe; Tatsuo Chiyonobu; Kaoru Hashimoto; Kyoichiro Kawano, all of Kawasaki, Japan

[73] Assignee: Fujitsu Limited, Kawasaki, Japan

[21] Appl. No.: 261,926

[22] Filed: Jun. 17, 1994

[30] Foreign Application Priority Data

Sep. 20, 1993 [JP] Japan ..... 5-233864

[51] Int. Cl.[6] ..... H01R 3/08

[52] U.S. Cl. ..... 439/179; 439/844

[58] Field of Search ..... 439/178, 179, 439/844, 853, 874, 876

[56] References Cited

U.S. PATENT DOCUMENTS 2,935,722 5/1960 Kacin ..... 439/179

FOREIGN PATENT DOCUMENTS 60-15952 1/1985 Japan .
60-136184 7/1985 Japan .
60-253177 12/1985 Japan .
62-105379 5/1987 Japan .
0071578 3/1991 Japan .
0583497 12/1977 U.S.S.R. .

OTHER PUBLICATIONS

IBM Technical Disclosure Bulletin, vol. 21 No. 11, Apr. 1979.

*Primary Examiner*—Khiem Nguyen

*Attorney, Agent, or Firm*—Nikaido, Marmelstein, Murray & Oram LLP

[57] ABSTRACT

A first contact member comprises a liquid conductor which comes into contact with a second contact member so as to establish the electric connection between the two contact members. A container contains the first contact member therein. The second contact member is pin-shaped. The container is tube-shaped and has a containing portion, which is filled with the liquid conductor, and has an opening through which the second contact member is inserted. An area contraction portion for contracting the cross sectional area of the container is formed at a position between the containing portion and the opening. The container is installed in a through hole provided in a base member. The container includes a pipe member of an electric conductor which comes into direct contact with the liquid conductor and a plug member to be inserted into the hole, before the pipe member is inserted, for preventing the liquid conductor from escaping from the container. The container is formed of elastic material. The portion of the container near to the opening is split into segments and portions of the segments are positioned away from each other as the portions are near to the opening so that the outer diameter of the segments is larger than the inner diameter of the hole before the container is installed into the hole, the segments approaching each other as the container is being inserted into the hole against the elastic force of the segments.

24 Claims, 14 Drawing Sheets

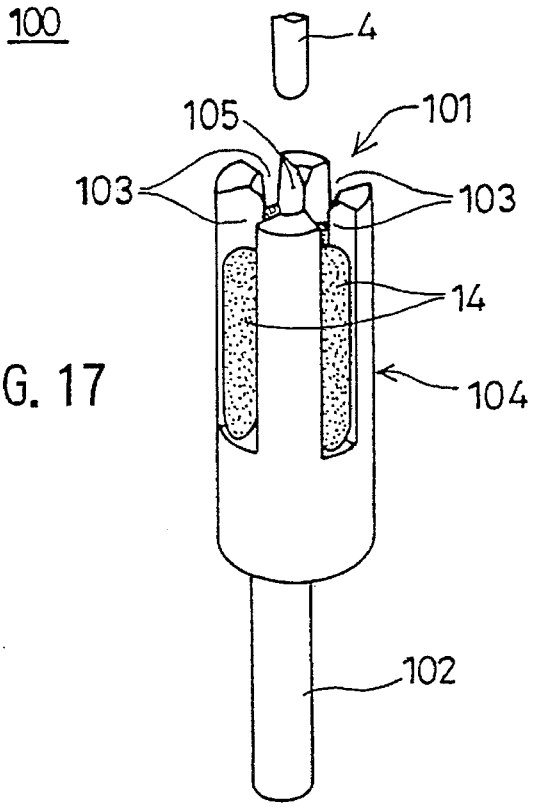
FIG. 17
FIG. 18A
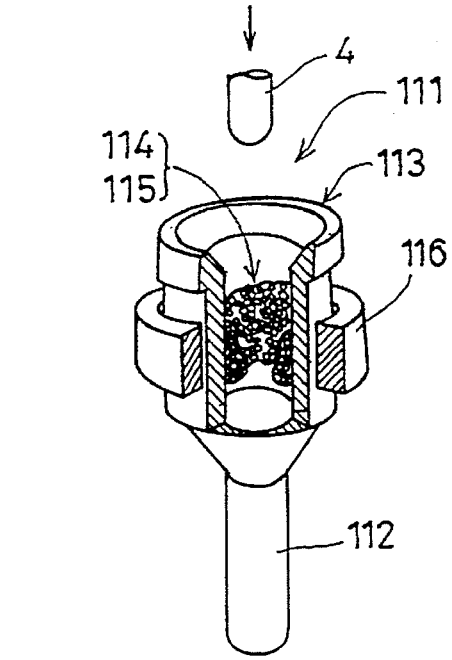
FIG. 18B
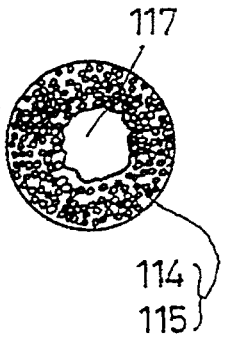

CONNECTOR EMPLOYING LIQUID CONDUCTOR FOR ELECTRICAL CONTACT

BACKGROUND OF THE INVENTION

1. Field of the Invention

The present invention relates to a connector and in particular to a connector for connecting a high-density semiconductor device, such as that to be used in a large scale computer or the like, onto a substrate using a ZIF (zero insertion force) or a LIF (low insertion force).

Such a connector may be used in an information processing system such as that, for example, employing a very large scale high performance computer. In such a case, development of very large scale integrated circuits has made it possible to increase operation speeds and circuit densities of logical/storage circuit devices, it thus being possible to provide individual devices having high-speed and high-density.

Such a connector for connecting units having such devices thereon is thus in demand to increase the number of terminals (contact members) which may be provided and the terminal (contact member) density in the connector.

2. Related Art

One example of the connector is a solid connector which uses an elastic contact force of a spring contact member to establish an electric connection between a connection pin (male connector) and a contact member (female connector).

Another example of the connector is a liquid connector employing a liquid metal so as to realize a connection with the ZIF or LIF. In such a liquid connector, a liquid metal is directly coated or plated on the contact portion of the connector, or a container is provided for containing the liquid metal, a connection pin being immersed in the liquid metal in the container so that the electrical connection is established.

However, the construction of the solid connector such as that mentioned above limits how much the terminal-density thereof can be increased. Further, an elastic force is required to ensure the electric connection reliability between the connection pins and the contact members in the connector. Maintenance of the elastic force results in generation of the friction force required when the connection pin is being connected with/disconnected from contact members in the connector. The friction force is increased as the number of terminals provided in the connector is increased due to the demand mentioned above, the connector thus becoming inconvenient to use.

Such forces required for connecting/disconnecting operations may be reduced/eliminated by driving the contact members in the connector so as to prevent the contact members from coming into contact with the connection pins when the connection pins are inserted into/withdrawn from the connector. However, such a contact-member driving mechanism may complicate the construction of the connector.

Further, a solid connector has another problem. That is, the solid connector needs a construction which can bear the to have elastic force to ensure the electrical connection reliability mentioned above, the elastic force being increased as the number of contact members are increased as mentioned above. Such a construction prevents the connector from being miniaturized. Also the elastic force may reduce the life time of the connector. A liquid connector such as that described above also has problems. That is, a highly accurate liquid surface control system is needed to prevent the liquid metal from being splashed/leaked from the container. Thus, such a liquid connector is not suitable for general use.

SUMMARY OF THE INVENTION

An object of the present invention is to provide a connector having a simple construction, which connector enables a force required for insertion/withdrawal of connection pins to be reduced and ensures electric connection between the connection pins and the contact members in the connector.

In order to achieve the above object, a connector according to the present invention comprises:

a first contact member comprising a liquid conductor which comes into contact with a second contact member so as to establish an electric connection between the two contact members; and a container for containing said first contact member therein;

and wherein said container has means for allowing said second contact member to be inserted into said container and for preventing said liquid conductor in said container from being splashed.

By employing the liquid conductor (may be liquid metal) as the first contact member, the ZIF insertion operation may be achieved as the second contact member is immersed in the liquid conductor so that the reliable electrical connection between the first and second contact member may be obtained. Further, employment of the means for allowing said second contact member to be inserted into said container and for preventing said liquid conductor in said container from being splashed enables easy realization of the liquid-surface control.

It is preferable that the above means comprises an area contraction portion formed at an approximate position in said container for contracting the cross section area of said container. In this case, the container may be formed of a pipe material having the area contraction portion/member installed at a position near a first end opening thereof, into which opening the second contact member (may be pin-shaped) is inserted. Thus, the manufacturing of the connector is simple. Further, a plug may be provided to plug a second end opening of the pipe material opposite to the first end opening. Thus, the liquid conductor is prevented from leaking through the second end opening.

It is preferable that:

said container is installed in a hole provided in a base member;

said container is formed of an elastic material; and the portion of said container near to said first opening is split into segments and portions of said segments are positioned away from each other as said positions are near to said opening so that the outer diameter of said segments is larger than the inner diameter of said hole before said container is installed into said hole, said segments approaching each other as said container is inserted into said hole against the elastic force of said segments.

Such a construction makes it easier to insert the container into the hole of the base member since each of the segments is cone-shaped before being inserted into the hole, the small-diameter top of each of the cones being first inserted into the hole. Then, after being inserted into the hole, the elastic force of the segments, which force is a pressing force exerted by the segments against the inner wall of the hole, prevents the container from coming out of the hole.

It is preferable to provide a lead for either the container or the first contact member so that it is easy to connect an electrical circuit to the connector using the lead.

The connector may be provided with two openings through which the two second contact members are inserted. In this case, two area contraction portions/members are provided for the two opening. Thus, advantages same as the above mentioned advantages obtained by the connector according to the present invention can also be obtained even in the above-mentioned double second-contact-member insertion type connector. The construction of such a double second-contact-member (connection pin) insertion type connector increases the density of connection pins inserted into each substrate.

It is preferable to provide a land in the hole of the base member so that the land may be used as the intermediate conductor together with the first contact member (liquid conductor) to connect the second contact member with the lead.

It is preferable to use either the liquid conductor of magnetic material or the liquid conductor with which magnetic material is mixed. In this case, a magnet is provided adjacent to the container. Thus, the splashing of the liquid conductor may be prevented through the magnetic attraction force effected between the magnet and the liquid conductor.

It is preferable to form the container using the pipe-shaped land installed in the hole of the base member and a plug installed at the second end of the land opposite to the first end through which the second contact member is inserted. In this case, the area contraction member is provided at the first end of the land. Such a simple contraction of the container may also simplify the manufacturing process of the connector.

It is preferable to form the container using either a through hole or a concavity provided on a conductor plate, the capillary attraction force maintaining the liquid conductor in the hole/concavity so that the splashing of the liquid conductor is prevented.

Grains may be contained in said container together with said liquid conductor, the grains resisting a flow of the liquid conductor in the container. Thus, the splashing of the liquid conductor may be prevented and the LIF close to ZIF connection pin insertion may be realized when the connection pin is inserted into the mix of the liquid conductor and grains. It is further preferable to use the grains having magnetic properties and to provide a magnet installed adjacent to the container. Thus, the magnetic attraction force attracting the grains surely prevents the liquid conductor from being splashed. Further, by using the grains having a rust prevention treatment performed thereon, pollution of the liquid conductor due to rust forming on the grains can be prevented.

In the above case, an insulating substrate may be used as the base member and the hole formed in the substrate may be used as the container. By providing a lead so that one end of the lead come into contact with the liquid conductor, the second contact member (connection pin) and the lead may be electrically connected through the liquid conductor although the container is not a conductor. Thus, a connector design having design flexibility is obtained.

Other objects and further features of the present invention will become more apparent from the following detailed description when read in conjunction with the accompanying drawings.

BRIEF DESCRIPTION OF THE DRAWINGS

FIG. 17 shows a perspective view of an embodiment obtained as a result of modifying the above ninth embodiment of the present invention;

FIG. 18A shows a partially cut-out perspective view of a connector in a tenth embodiment of the present invention;

FIG. 18B shows a partial plan view of the connector shown in FIG. 18A;

DESCRIPTION OF THE PREFERRED EMBODIMENTS

Figure 2A:
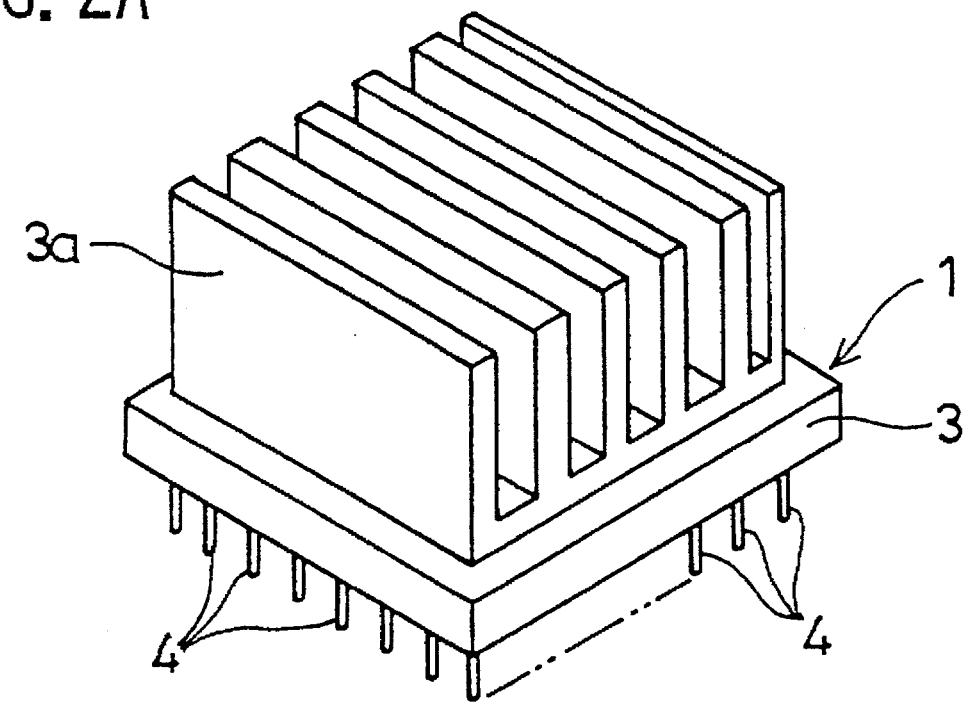
FIGS. 2A and 2B show perspective views of a connector according to the present invention used for connecting a semiconductor device.
Figure 2B:
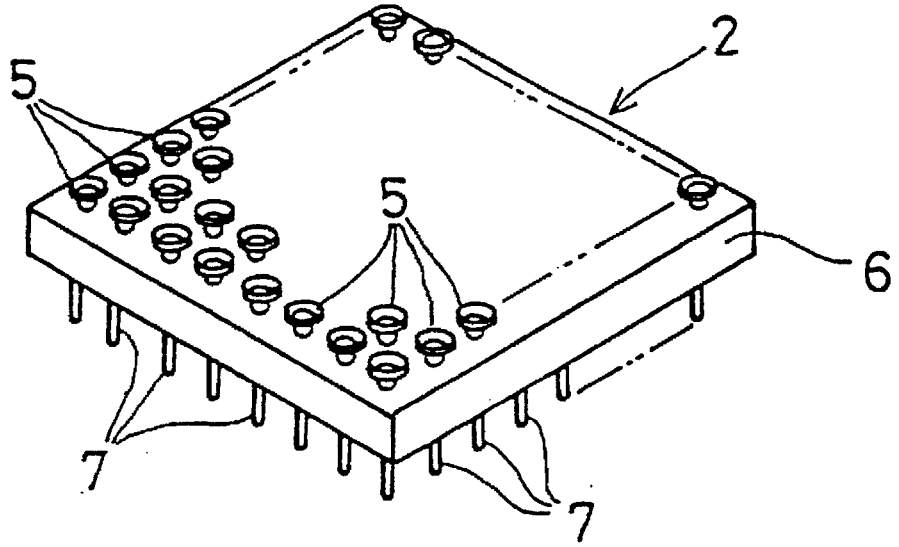

With reference to FIGS. 2A and 2B, a semiconductor device 1 is installed, for example, in a large computer, the device 1 being loaded on a socket 2. The device 1 has an LSI (large scale integrated circuit) contained in a ceramic package 3 and radiator fins 3*a* provided above the package 3. The package has a PGA (pin grid array) type construction so that a plurality of connection pins 4 project downward from the bottom surface of the package 3. Thus, the connection-pin density is increased.

The socket 2 includes a ceramic insulation substrate 6 and a plurality of contacts 5 installed in the substrate 6. Further, the socket 2 includes a plurality of leads 7 projecting downward from the bottom surface of the insulating substrate 6, the leads being connected to a circuit substrate (not shown in the figures) in the computer. The contacts 5 are electrically connected with the leads 7 as will be described in the description of each embodiment of the present invention. Some embodiments have constructions so that no leads 7 are provided on the substrate 6, depending on the method of connecting the contacts 5 with the circuit substrate of the computer.

In order to load the semiconductor device 1 on the socket 2, the connection pins 4 are inserted into the contacts 5. The connection pins 4 and contacts 5 constitute a connector system. The ease with which the semiconductor device 1 is loaded on/unloaded from the socket 2 depends on a force required to insert/withdraw the connection pins 4 into/from the contacts 5 in the connector system. The insertion/withdrawal force required increases as the numbers of the connection pins 4/contacts 5 increase.

As mentioned above, an object of the present invention is to reduce/eliminate the insertion/withdrawal force in the connector system, that is, to achieve the ZIF or LIF operation in the connector system.

A connector/connector system in each embodiment of the present invention will now be described.

Figure 1:
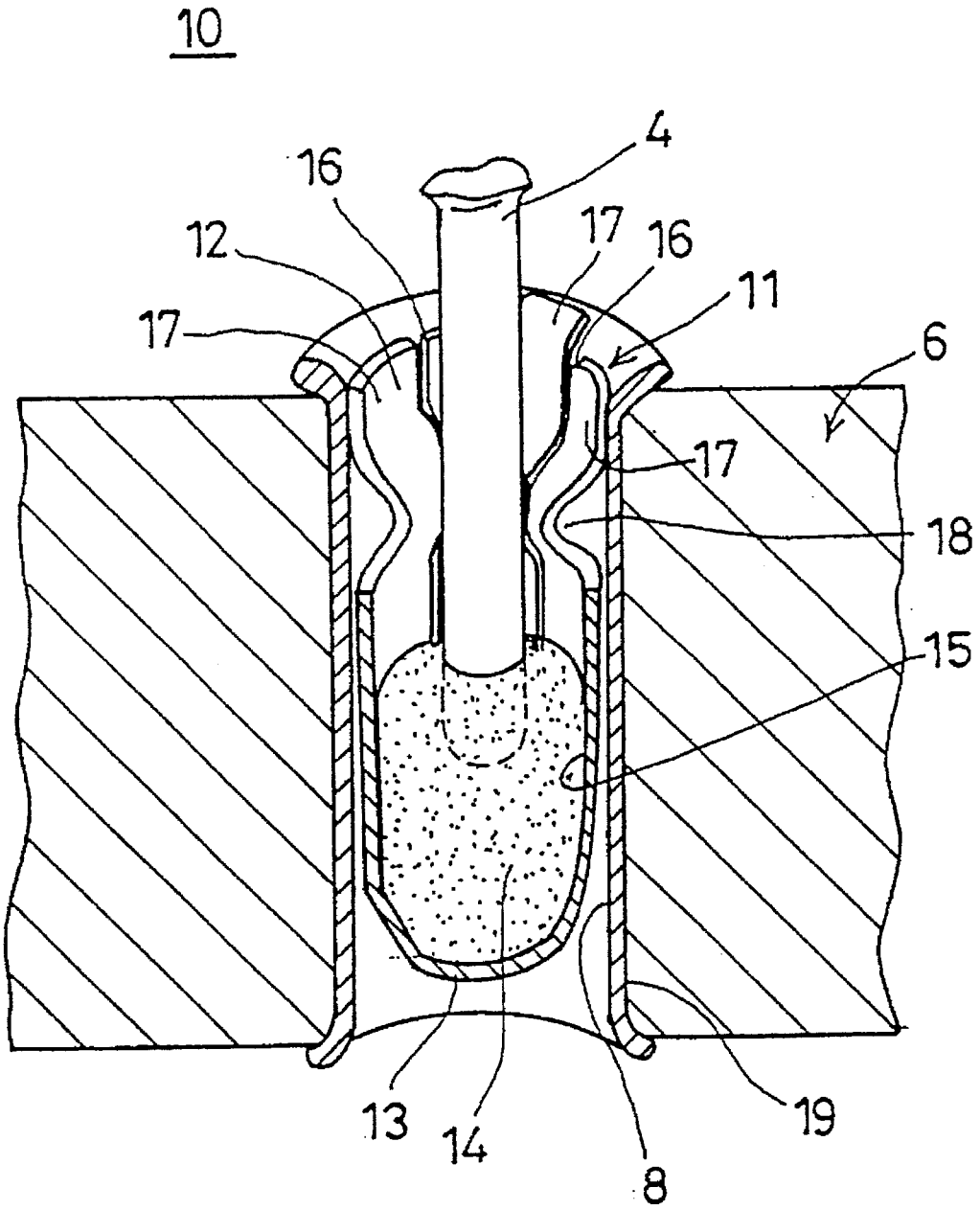
FIG. 1 shows a sectional side elevation view of a connector in a first embodiment of the present invention.

With reference to FIG. 1, a connector system 10 in a first embodiment of the present invention will now be described. The connector system 10 comprises a connection pin 4 and a contact 11. The connection pin 4 is installed on the semiconductor device 1 as shown, for example, in FIG. 2. The contact 11 is installed in a insertion hole 8 formed in the insulation substrate 6.

The contact 11, which is cylindrical, has an opening 12 at the top thereof through which the connection pin 4 is inserted and has a bottom portion 13 at the bottom end thereof. The lower half of the contact 11 is a containing portion 15 in which a liquid metal 14 (indicated by dotting in FIG. 1), which will be described later, contained. The upper half of the contact 11 has a plurality of slits 16 which split the upper half into a plurality of segments 17.

An area contraction portion 18 is formed in the segments between the opening 12 and the containing portion 15. The inner diameter of the area contraction portion 18 is smaller than the diameter of the opening 12 and larger than the diameter of the connection pin 4.

The contact 11 is made of conductive metal such as copper, gold, silver or the like.

The insertion hole 8 has a land 19 provided on the wall thereof, the land 19 being cylindrical. The land 19 is provided over the entire length of the hole 8 and fitted in the hole 8. The land 19 is made of a conductive material such as copper and may act as a connection terminal to be used for establishing an electrical connection with a circuit substrate in, for example, a computer. As will be described, the loading of the contact 11 in the land 19 establishes the electrical connection between the contact 11 and the land 19.

The liquid metal may be made of various materials such as alloy of indium (In) and tin (Sn), alloy of In and aluminum (Al), alloy of gallium (Ga) and Sn, alloy of Ga and Al, alloy of Ga and In, or the like. Since the liquid metal should be in the liquid phase at a normal temperature, the melting point thereof may be approximately 20° C.

In order to establish an electrical connection between the connection pin 4 and the contact 11, the connection pin 4 is inserted into the contact 11 and then is immersed in the liquid metal 14 contained in the containing portion 15. Since the connection pin 4 is thus electrically connected with the contact 11 via the liquid metal 14, the ZIF insertion/withdrawal operation may be achieved. Thus, the force required to insert/withdraw the connection pin 4 into/from the contact 11 may be a small one. As a result, even if many connection pins 4 are provided on the semiconductor device 1 as shown in FIG. 2A and they are inserted into/withdrawn from the corresponding contacts 5 installed on the insulation substrate 6, only a small force is needed for the insertion/withdrawal operations. Thus, the loading/unloading operations of the semiconductor device 1 on/from the insulation substrate 6 may be easily carried out.

The area contraction portion 18 allows the connection pin 4 to be inserted and prevents splashing of the liquid metal contained in the containing portion 15. Thus, surface control of the liquid metal 14 can be ensured.

Methods of fabricating the contact 11 and loading the contact 11 into the hole 8 will now be described with reference to FIGS. 3, 4, 5 and 6. In each figure, only the top part of the land 19 is indicated.

Figure 3:
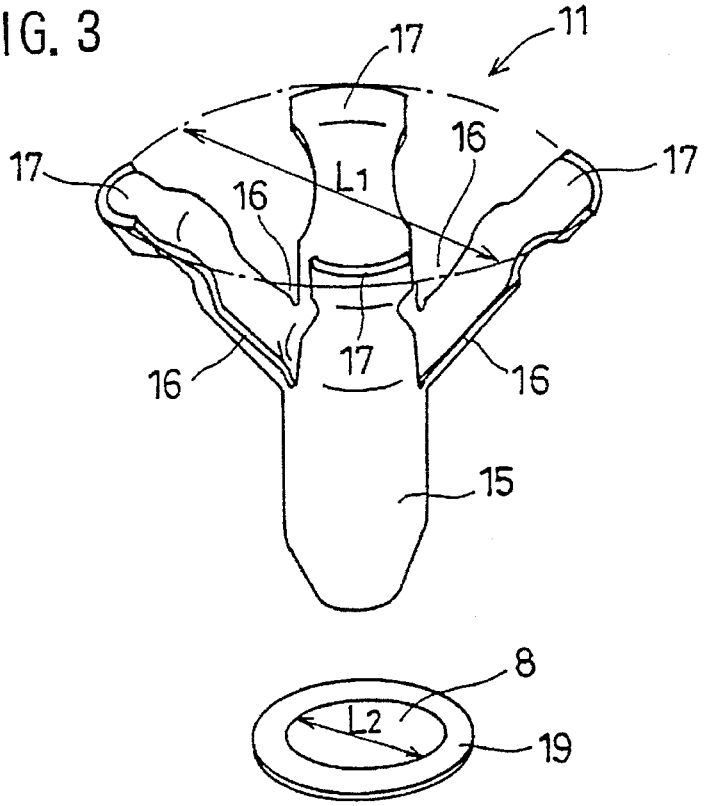
FIGS. 3, 4, 5 and 6 show perspective views illustrating a process for fabricating a contact used in the connector in the first embodiment of the present invention and a process for installing the contact in a hole provided in an insulation substrate.

FIG. 3 shows a state where the contact 11 has not been inserted into the hole 8. As mentioned above, the contact has the segments 17 (four segments in this embodiment) and the inner diameter $L_1$ of the circle (indicated by the chain line in FIG. 3) formed by the tops of the segments is larger than the diameter $L_2$ of the hole 8. The outer diameter of the containing portion 15 is approximately the same as the diameter $L_2$ of the hole 8. As shown in FIG. 3, the segments 17 are cone-shaped, the top of each cone being directed downward. The contact 11 may be easily formed using the press-drawing process or the like. Each one of the segments 17 has a wave portion 18*a* shown in FIG. 4 which forms the area contraction portion 18 after the contact 11 has been completely inserted into the hole 8.

Figure 4:
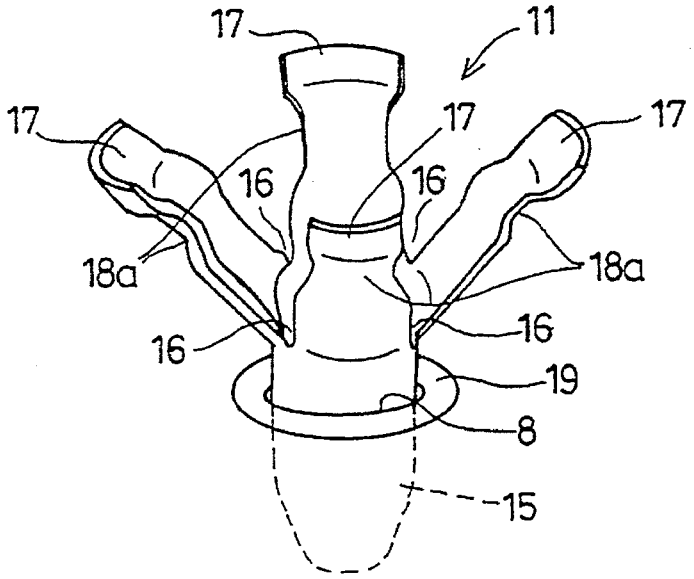
Figure 5:
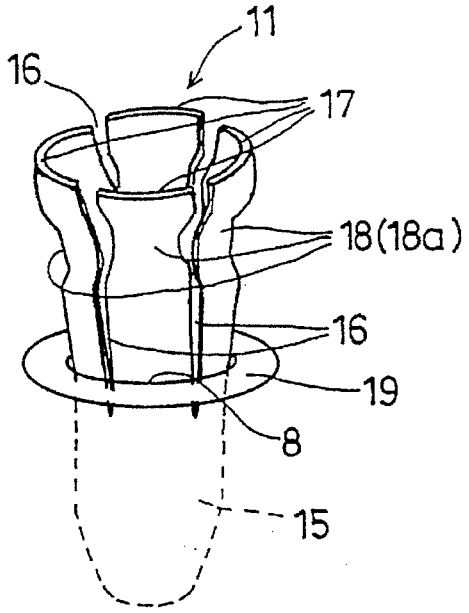

FIGS. 4 and 5 illustrate a process for temporarily loading the contact 11 into the hole 8, the containing portion 15 being inserted first into the hole 8 as shown in FIG. 4. Since the segments 17 have not been inserted into the hole 8 yet, the segments 17 maintain the same shape as that shown in FIG. 3, that is, a large-diameter state. The large-diameter state segments 17 are easy for a worker to handle and thus the contact 11, although it is small, can then be inserted into the hole 8.

Then, as shown in FIG. 5, the contact 11 is further inserted into the hole 8. Accordingly, the angles formed by the segments 17 are reduced and thus the diameter of the circle formed by the tops of the segments is reduced. The wave portions 18*a* are thus made to approach each other so as to form the area contraction portion 18.

Figure 6:
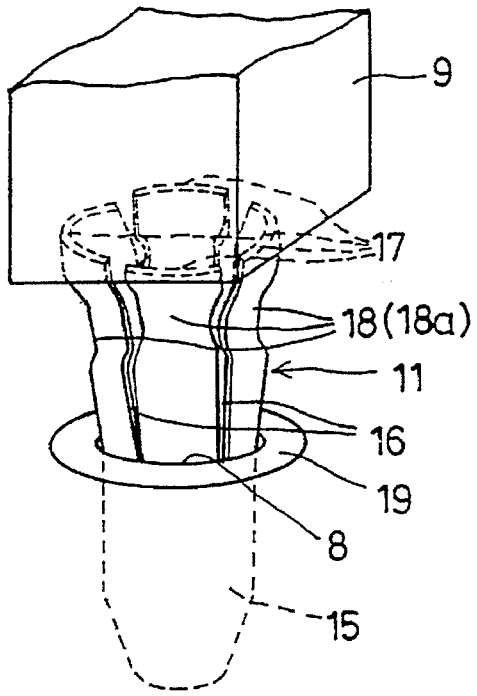
Figure 7:
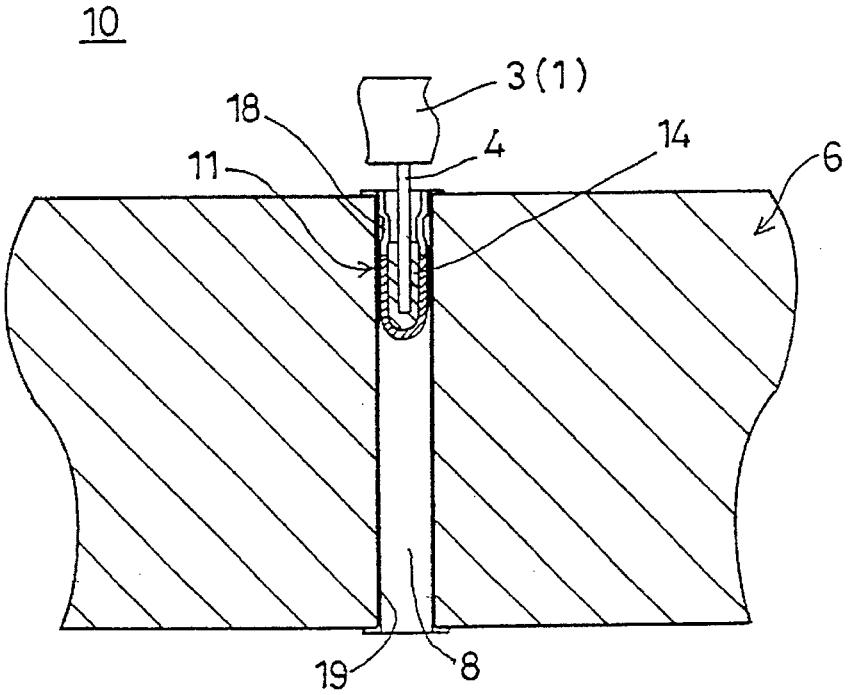
FIG. 7 shows a sectional side elevation view of the contact installed in the insulation substrate as shown in FIGS. 3, 4, 5 and 6.

Such a temporary loading process illustrated in FIGS. 4 and 5 is carried out for each contact 11 to be loaded into the insulation substrate 6 (see FIG. 2B). After the completion of the temporary loading process, an insertion die 9 is used to further insert the contact 11 into the hole 8 as shown in FIG. 6. Thus, the series of processes described above with reference to FIGS. 4, 5 and 6 completes the insertion of the contact 11 into the hole 8 so that the state shown in FIG. 7 is obtained.

Such a construction of the contact 11 makes it easier to insert the contact 11 into the hole 8 since the segments 17 are cone-shaped before being inserted into the hole 8 and the small-diameter top of each cone shape is first inserted into the hole 8. Then, after being inserted into the hole 8, the elastic force of the segments 17, which force is a pressing force exerted by the segments 17 against the wall of the hole 8, prevents the contact 11 from coming out of the hole 8 and ensures the electrical connection between the land 19 and the contact 11. The above elastic force is generated as a result of the initial shape of the segments 17 shown in FIG. 4 (like an opened flower petal) being transformed into the shape shown in FIG. 1 (like a closed flower petal) during the above series of processes.

Figure 8:
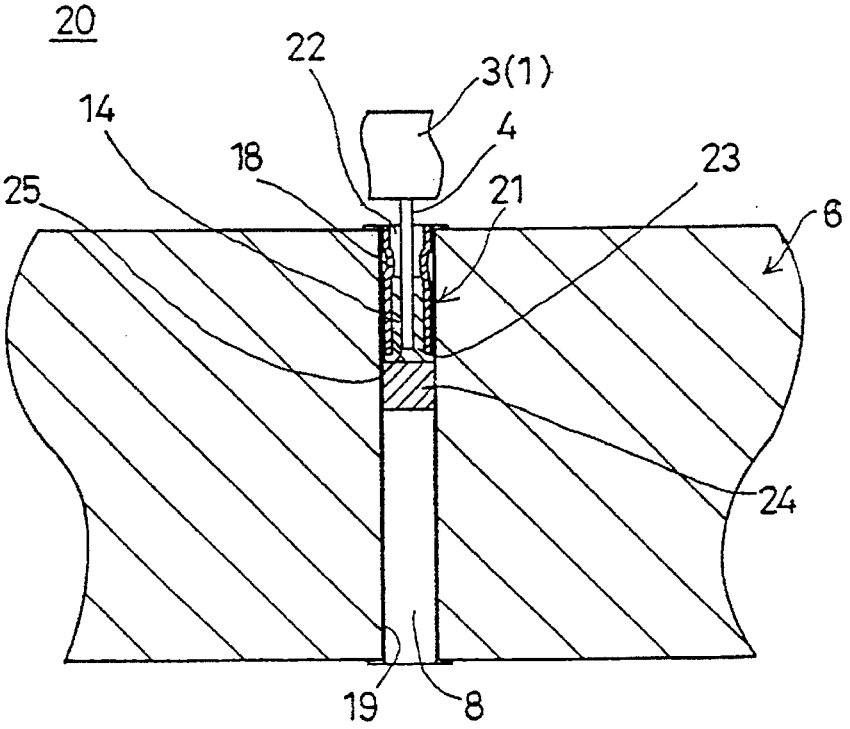
FIGS. 8, 9, 10, 11, 12, 13, 14 and 15 show sectional side elevation views of connectors in second, third, fourth, fifth, sixth, seventh, eighth embodiments and an embodiment obtained as a result of modifying the eighth embodiment of the present invention.

With reference to FIG. 8, a connector system 20 in a second embodiment of the present invention will now be described. Elements identical to those in the connector system 10 in the first embodiment of the present invention have reference numerals the same as those of the elements in the connector system 10 and the description of these elements will be omitted.

The connector system 20 has a contact 21 having at the top thereof a first opening 22, through which opening the connection pin 4 is inserted. A second opening 23 is provided on the bottom end of the contact 21. The connector system 20 further includes a closing member 24 for closing the insertion hole 8 under the second opening 23, the member 24 facing the opening 23.

The closing member 24 is made of elastic material such as silicon rubber and is loaded into the hole 8 prior to the loading of the contact 21. The closing member 24 seals the hole 8 liquid-tightly and thus acts as the bottom of a containing portion 25, which includes the contact 21 therein so as to keep the liquid metal 14 in the containing portion 25.

The area contraction portion 18 is formed in the contact 21 between the first opening 22 and the containing portion 25, which portion 18 allows the connection pin 4 to be inserted therethrough and prevents the liquid metal 14 contained in the containing portion 25 from being splashed.

Similarly to the manner in the connecter system 10, the connection pin 4 is electrically connected to the contact 21 in a manner in which the connection pin 4, after being passed through the first opening 22, is then immersed into the liquid metal 14 contained in the containing portion 25. Thus, the above electric connection is performed in the ZIF condition via the liquid metal 14.

The contact 21 having the simple pipe-shape and the openings 22 and 23 as its ends thus may be manufactured easily. The closing member 24 prevents the liquid metal 14 from downwardly escaping from the containing portion 25.

Figure 9:
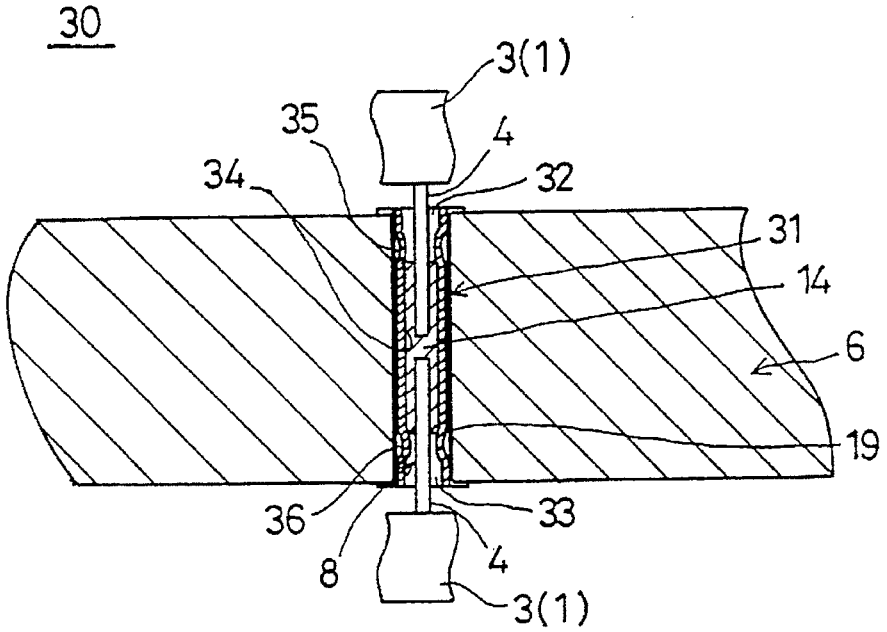

With reference to FIG. 9, a connector system 30 in a third embodiment of the present invention will now be described. Elements identical to those in the connector system 10 in the first embodiment of the present invention have reference numerals the same as those of the elements in the connector system 10 and the description of these elements will be omitted.

The connector system 30 includes a contact 31 having the length similar to that of the insertion hole 8 and first and second openings 32 and 33 at the top and bottom of the contact 31. The connection pins 4 are inserted into the openings 32 and 33. The contact 31 further includes a containing portion 34 between the openings 32 and 33 for keeping the liquid metal 14 therein. The liquid metal 14 is maintained at the approximate middle of the contact 31 due to the capillary phenomenon.

The contact 31 further includes area contraction portions 35 and 36 formed thereon between the opening 32 and the containing portion 34 and between the opening 33 and the containing portion 34, respectively. The contraction portions 35 and 36 allow the connection pins 4 to be inserted therethrough and prevent the liquid metal 14 contained in the containing portion 34 from being splashed.

Inserting the connection pins 4 via the first and second openings 32 and 33 and then immersing them into the liquid metal 14 present in the containing portion 34 result in the connection pins 4 being electrically connected to the contact 31. Thus, the electrical connection is performed in the ZIF condition. Such a construction as that of the connector system 30 allows the number of the connection pins 4 which may be inserted into the insulation substrate 6, such as shown in FIG. 2B, to be increased. This is because the connection pins 4 may be inserted into both sides of the insulation substrate 6.

Figure 10:
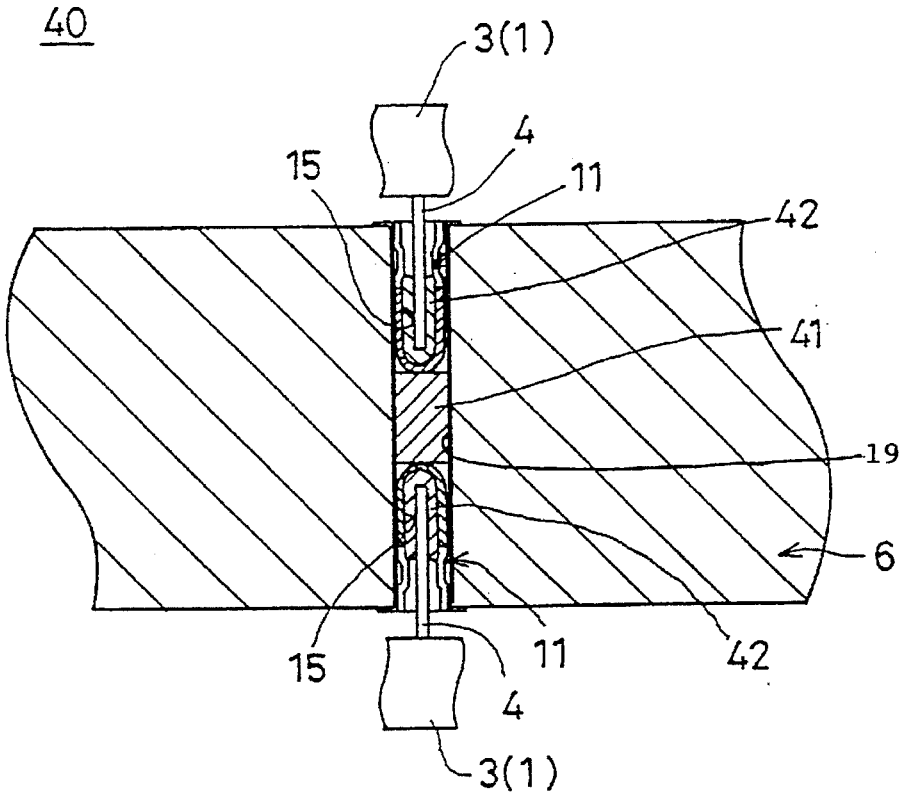

With reference to FIG. 10, a connector system 40 in a fourth embodiment of the present invention will now be described. Elements identical to those in the connector system 10 in the first embodiment of the present invention have reference numerals the same as those of the elements in the connector system 10 and the description of the elements will be omitted.

The connector system 40 includes the upper and lower contacts 11, each of which is identical to the contact 11 used in the connector system 10 (see FIGS. 1 and 7). Provision of the two contacts 11 at the top and bottom of the insertion hole 8 allows the number of the connection pins 4 which may be inserted into the insulation substrate 6 to be increased. The connector system 40 further includes a magnet 41 (which is an essential element in the fourth embodiment) provided in the space formed between the pair of the contacts 11. Liquid metal 42 is kept in the containing portions 15 formed in the contacts 11, the liquid metal 42 being a magnetic substance or ordinary liquid metal including magnetic material mixed therein.

The liquid metal 42 is accordingly attracted by the magnet 41 due to the magnetic properties of the magnet 41 and the liquid metal 42 itself. Since the liquid metal 42 is attracted to the bottom of the contacts 11, that is, is thus maintained in the containing portions 15 in the contacts 11, prevention of splashing of the liquid metal 42 can be ensured. In particular, the construction employing the magnetic properties is effective in maintaining the liquid metal 42 in the lower contact 11, which metal 42 might otherwise fall from the lower contact 11 via the opening 12 (shown in FIG. 1) thereof provided at the bottom of the hole 8 if the magnetic properties were not employed.

The magnet 41 in the connector system 40 is not limited to that in the hole 8 as shown in FIG. 10. Instead, the magnet 41 may be in any position where the magnet 41 can prevent the liquid metal 42 present in the containing portions 15 from coming out, that is, where the magnet 41 is located at a position at a side of the contacts 11 opposite to the side through which the liquid metal likely to escape. The magnet 41 may thus be positioned to surround the contacts 11 and be outside of the hole 8 in the insulation substrate 6 instead of being positioned within the hole 8.

Figure 11:
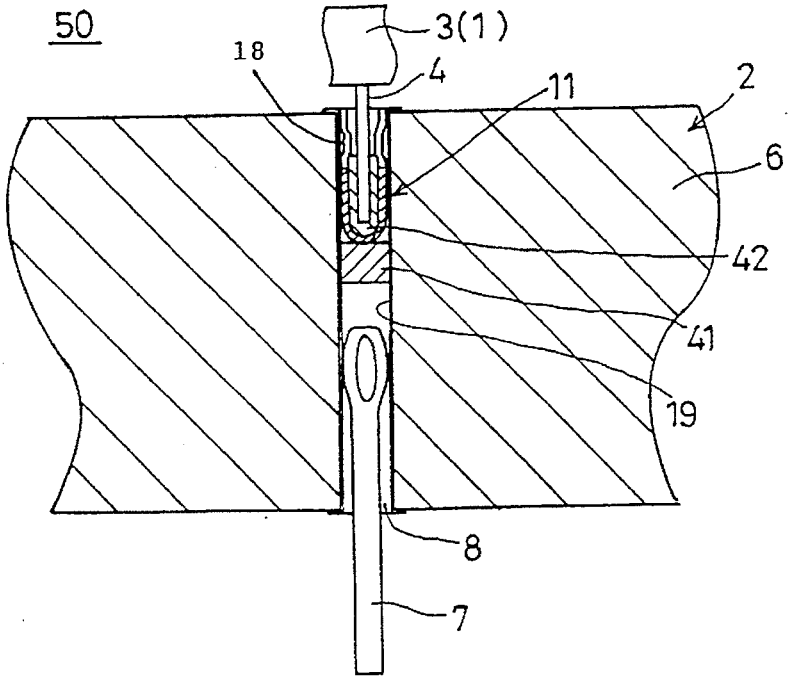

With reference to FIG. 11, a connector system 50 in a fifth embodiment of the present invention will now be described. Elements identical to those in the connector system 40 in the fourth embodiment of the present invention have reference numerals the same as those of the elements in the connector system 40 and the description of the elements will be omitted.

The connector system 50 is a system in which the lower contact 11 in the connector system 40 shown in FIG. 10 is replaced by the lead 7. The top of the lead 7 is electrically connected to the upper contact 11 via the land 19 of conductor. The bottom of the lead 7 projecting downward from the bottom surface of the insulation substrate 6 acts as an external connection terminal which may be connected to the outside of the substrate 6.

Thus, the connector system 50 enables the present invention to be applied to a socket such as that shown in FIG. 2B having the leads 7 projecting from the insulation substrate 6. The connector system 50 has the advantages that the ZIF connection through the liquid metal 42 is possible and that splashing of the liquid metal 14 can be prevented due to the presence of the area contraction portion 18.

Figure 12:
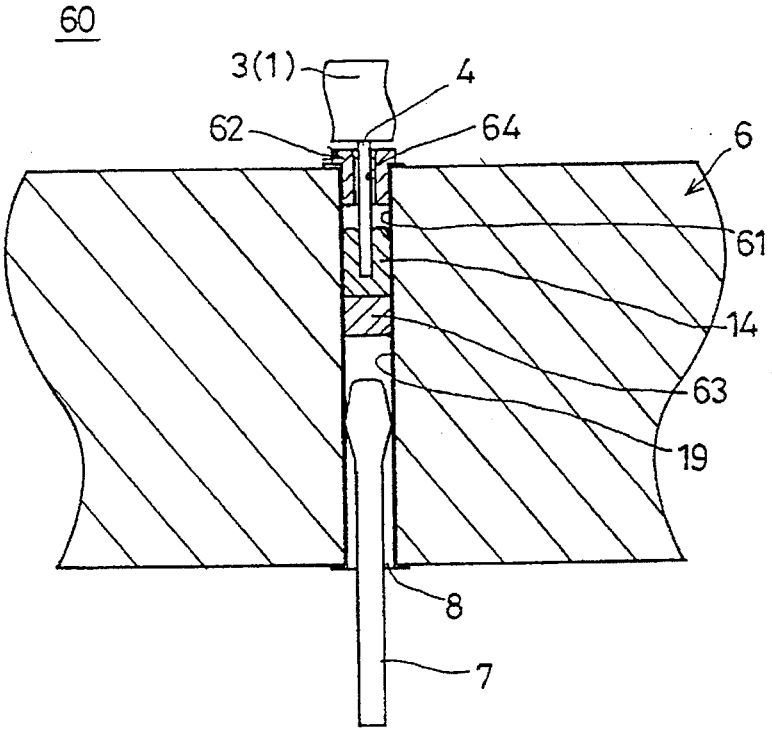

With reference to FIG. 12, a connector system 60 in a sixth embodiment of the present invention will now be described. Elements identical to those in the connector system 10 in the first embodiment of the present invention have reference numerals same as those of the elements in the connector system 10 and the description of the elements will be omitted.

The connector system 60 is characterized in that a containing portion 61 for keeping the liquid metal 14 therein is formed by the land 19, a stopper member 62 and a closing member 63 in the hole 8. The land 19 is provided in the wall of the hole 8 formed in the insulation substrate 6, similarly to the land 19 provided in the other connector systems in the embodiments described above.

The stopper member 62 is located at the top opening of the hole 8, through which opening the connection pin 4 is inserted, and has an insertion hole 64 therein. The diameter of the insertion hole 64 is smaller than the diameter of the hole 8 and larger than the diameter of the connection pin 4. The stopper member 62 is made of resin.

The closing member 63 inserted into the hole 8 is located under the stopper member 62 in the hole 8 so as to close the hole 8.

The lead 7 is provided at the lower part of the hole 8. The top of the lead 7 is electrically connected to the liquid metal 14 via the land 19 of conductor and the bottom of the lead 7 projecting downward from the bottom surface of the insulation substrate 6 acts as the external connection terminal.

Since the inserted connection pin 4 is thus electrically connected to the land 19 and thus to the lead 7 via the liquid metal 14, the ZIF connection can be achieved. Further, since the containing portion 61 is defined by the closing member 63 and the stopper member 62, the liquid metal 14 present in the containing portion 61 is prevented from coming out and from splashing. Further, the connector system 60 having no contact such as the contact 11 enables simplification of the connector system construction.

Figure 13:
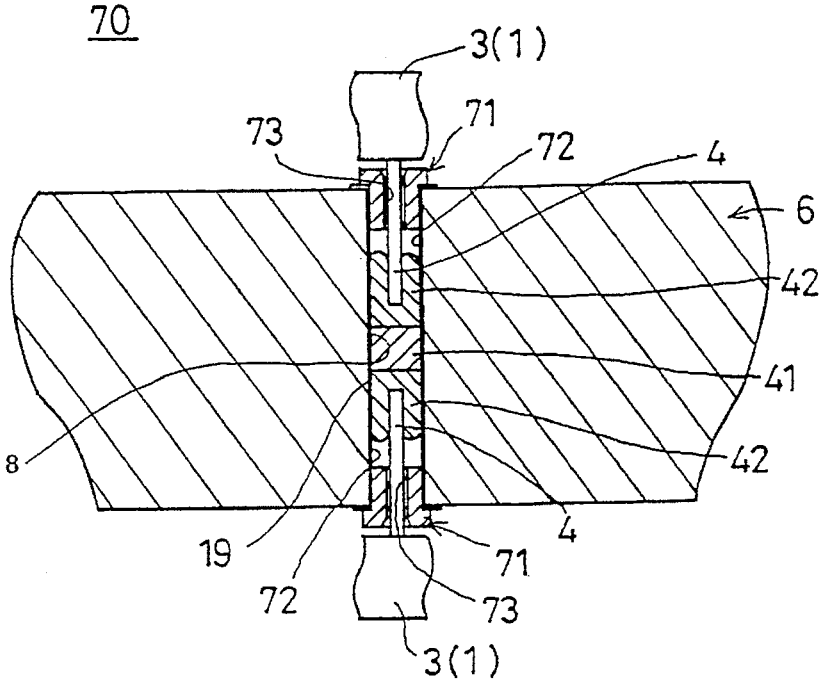

With reference to FIG. 13, a connector system 70 in a seventh embodiment of the present invention will now be described. Elements identical to those in the connector system 40 in the fourth embodiment of the present invention have reference numerals the same as those of the elements in the connector 40 and the description of the elements will be omitted.

The connector system 70 includes two stopper members 71 located at the top and bottom ends of the hole 8 and further includes the magnet 41 at the middle of the hole 8. Upper and lower containing portions 72, each of which keeps the liquid metal 42 therein, are formed by the land 19, the two stopper members 71 and the magnet 41, the magnet 41 being located between the two containing portions 72.

Similarly to the land 19 used in the other connector systems in the embodiments described above, the land 19 is provided on the wall of the hole 8 formed in the insulation substrate 6. Each of the stopper members 71 is identical to the stopper member 62 used in the connector system 60 in the sixth embodiment and has therein an insertion hole 73 identical to the hole 64 used in the connector system 60.

The connector system 70 employing no contact such as the contact 11 enables to the connector system construction to be simplified. Further, since both sides of the insulation substrate 6 may have the connection pins 4 inserted therein, the number of the connection pins 4 which may be inserted into the substrate 6 can be increased. Further, provision of the magnet 41 can ensure that the liquid metal 42, such as that described above present in the containing portions 72, is prevented from being splashed due to the magnetic properties of the magnet 41 and the liquid metal 42 itself as described above.

Figure 14:
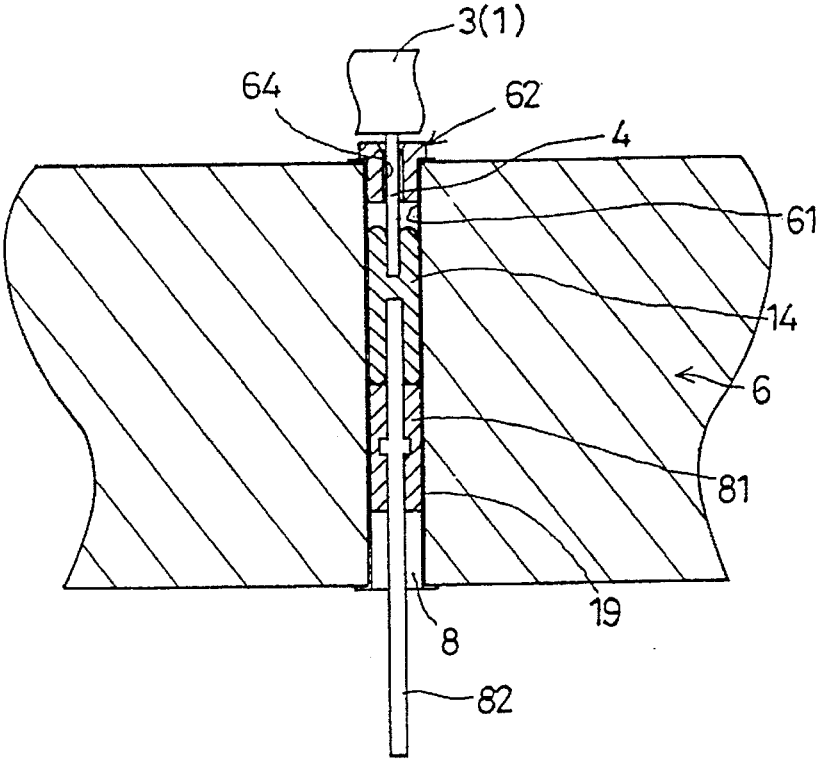

With reference to FIG. 14, a connector system 80 in a eighth embodiment of the present invention will now be described. Elements identical to those in the connector system 60 in the sixth embodiment of the present invention have reference numerals the same as those of the elements in the connector 60 and the description of the elements will be omitted.

Similarly to the connector system 60 shown in FIG. 12, the connector system 80 has a containing portion 61, for keeping the liquid metal 14 therein, formed by the land 19, stopper member 62 and a closing member 81, and has a lead 82 located at the bottom of the hole 8. The system 80 is characterized in that the top end of the lead 82 pierces the closing member 81 to be immersed into the liquid metal 14, and the bottom end of the lead 82 downward projecting from the bottom surface of the insulation substrate 6 acts as the external connection terminal.

Since this connector system construction thus enables the direct electrical connection of the lead 82 with the liquid metal 14, it is not necessary to provide a member such as the land 19 acting as a conductor. Thus, the construction of the connector system can be simplified, and thus the manufacturing process for the system may be simplified, resulting in the manufacturing cost thereof being reduced.

Figure 15:
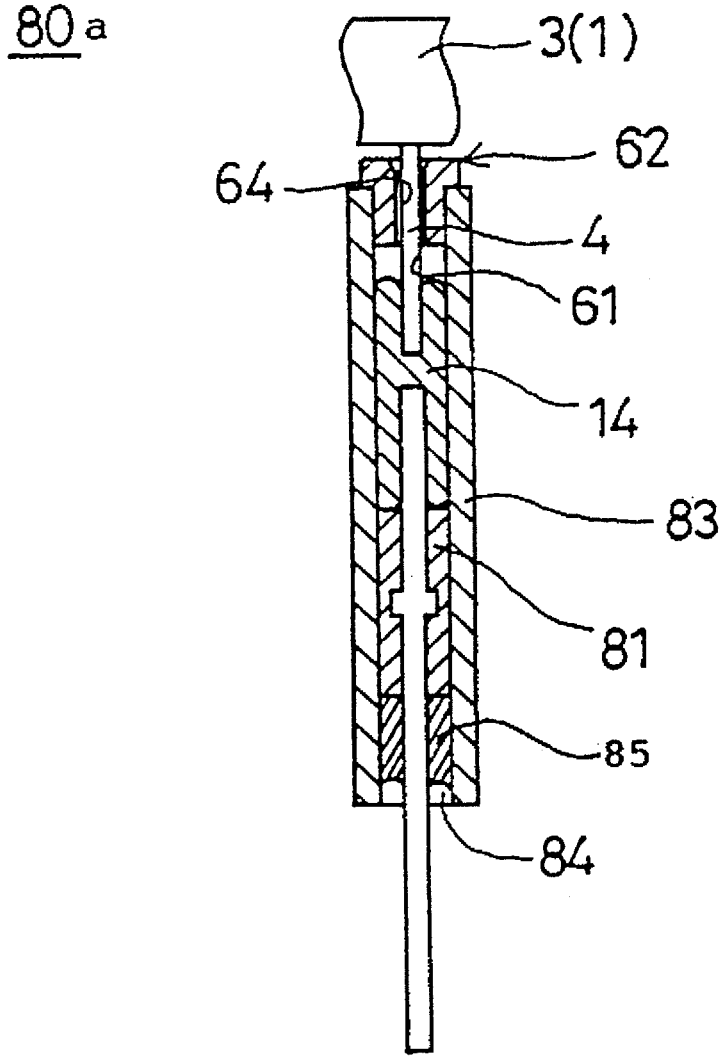

With reference to FIG. 15, a modification of the connector system 80, system 80*a*, in the eighth embodiment of the present invention will now be described. Elements identical to those in the connector system 80 have reference numerals the same as those of the elements in the connector 80 and the description of the elements will be omitted.

The connector system 80*a* is characterized in that the system 80*a* may be handled separately from the insulation substrate 6. In order to realize this feature, the system 80*a* includes an outer pipe 83. The outer pipe 83 may be made of either insulating or conductive metal and a hole 84 present within the outer pipe 83 acts as the insertion hole 8 in the other connector systems in the embodiments described above. The connector system 80*a*, which is characterized as described above and thus may be handled roughly in comparison with the case where the system is provided in the insulation substrate 6, and thus is specially provided with such as a sealing member 85 under the closing member 81. The sealing member 85 prevents the closing member 81 from coming out of the pipe 83 and also prevents the liquid metal 14 from leaking.

The provision of the connector system 80*a* enables the system to be handled more flexibly. If the system 80*a* is used together with the insulation substrate 6, formation of only a simple hole, into which the system 80*a* is to be loaded, in the insulation substrate 6 is needed. Thus, the insulation substrate 6 having such a simple construction can be easily manufactured. Further, the system 80*a* may be widely used as a connector system in various electronic-equipment applications.

With reference to FIGS. 16A, 16B, 16C and 17, connector systems 90, 90*a* and 100 in a ninth embodiment, and first and second variants of the embodiment of the present invention will now be described.

Figure 16A:
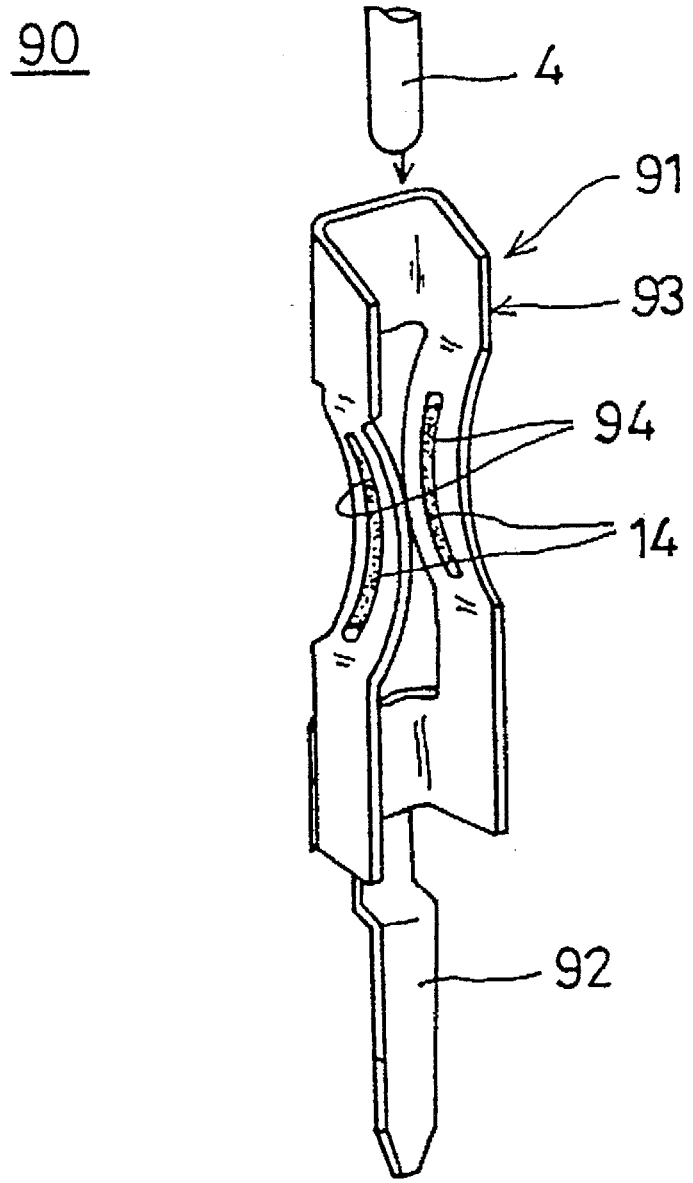
FIGS. 16A and 16B show perspective views of a ninth embodiment and an embodiment obtained as a result of modifying the ninth embodiment of the present invention.

The connector system 90 shown in FIG. 16A includes a contact 91 having a lead portion 92 at the bottom thereof and also having a containing portion 93 at the top thereof for keeping the liquid metal 14 therein. The entirety of the contact 91 is formed in a unit body through a pressing process performed on a conductive metal plate. The containing portion 93 has an angular-C-shaped cross section and the left and right walls of the portion 93 have long vertical holes 94. The connection pin 4 is inserted into the contact 91 vertically.

The long holes 94 are located so as to face the connection pin 4 loaded in the contact 91 and have the liquid metal 14 (indicated by dots in the figure) kept therein. The width of each of the long holes 94 is so narrow that the liquid metal is maintained therein due to the capillary phenomenon.

Further, the contact 91 is formed so that the long holes 94 are in proximity to the loaded connection pin 4 and thus the liquid metal 14 comes into contact with the pin 4. Thus, the connection pin 4 is electrically connected to the contact 91.

Figure 16B:
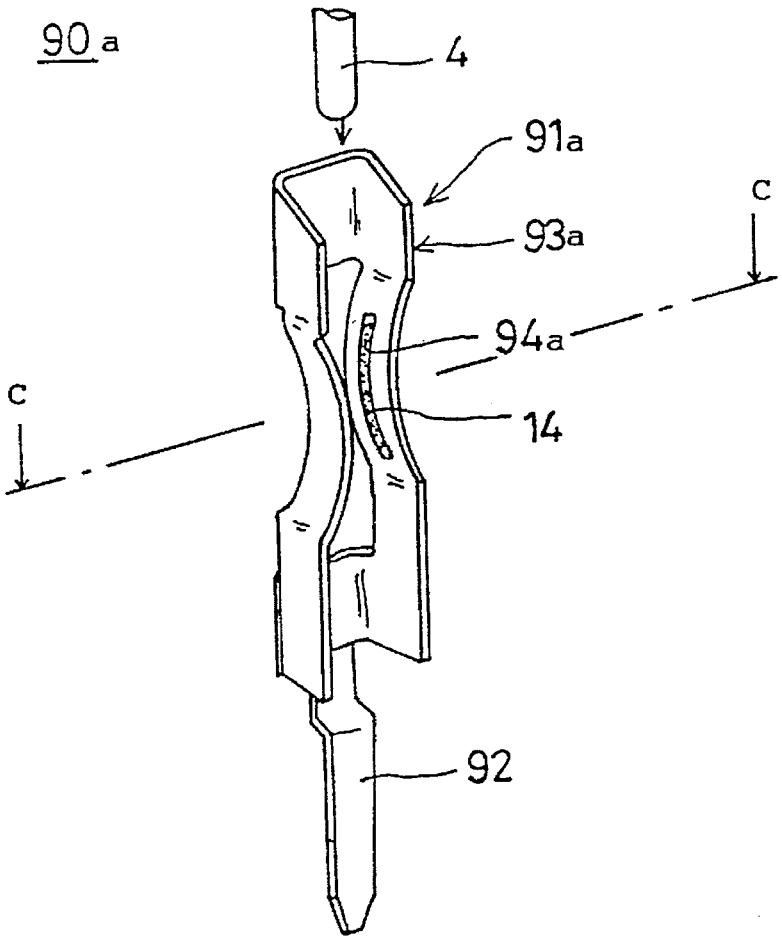
Figure 16C:
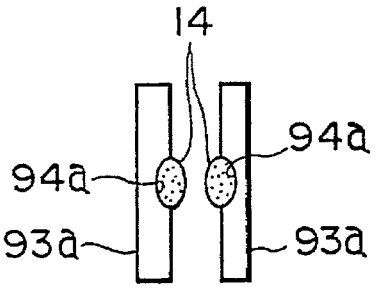
FIG. 16C shows a cross section of the connector shown in FIG. 16B taken along the line C—C of FIG. 16B.

A modification of the above connector system 90, system 90*a* will now be described with reference to FIGS. 16B and 16C. The connector system 90*a* includes a contact 91*a* identical to the contact 91 except that the contact 91*a* has a containing portion 93*a* instead of the containing portion 93. The portion 93*a* is identical to the portion 93 except that the portion 93*a* has the concavities 94*a* instead of the long holes 94. The concavities 94*a* have shapes identical to those of the long holes 94 except that the concavities 94*a* have the bottoms at the outer sides of the holes. Advantages similar to those of the connector system 90 can be obtained form the system 90*a* because they have similar constructions as described above. The amount of the liquid metal 14 in the system 90*a* may be smaller than the system 90 due to the difference between the constructions of the holes 94 and that of the concavities 94*a*.

The connector system 100 shown in FIG. 17 is characterized in including a contact 101 having a lead 102 formed at the bottom thereof and also having a containing portion 104 formed at the top thereof for keeping the liquid metal 14 therein. A plurality of slits (four slits in this variant) 103 are formed in the upper part of the containing portion 104 and an insertion hole 105 is formed at the axis part of the portion 104. The connection pin 4 is inserted into a hole 105. The shape of the contact 101 may be formed as a result of cutting a solid-cylindrical conductive metal material so that the contact 101 is in a unit body.

The slits 103 are long in a vertical direction, and the connection pin 4 being inserted vertically into the hole 105. The liquid metal 14 (indicated by dots in the figure) is kept in the slits 105. The width of each of the slits 105 is so narrow that the liquid metal is maintained therein due to the capillary phenomenon.

Further, the contact 101 is formed so that the long holes 14 are in proximity to the loaded connection pin 4 and thus the liquid metal 14 comes into contact with the pin 4. Thus, the connection pin 4 is electrically connected to the contact 101.

The connector systems 90, 90*a* and 100 include the respective contacts 91, 91*a* and 101 and thus have simple constructions. Further, the connection pin 4 can be connected to the contacts in the ZIF condition by employing the liquid metal 14. Further, similar to the system 80*a* shown in FIG. 15, each of the connector systems 90, 90*a* and 100 may be handled separately from a member such as the insulation substrate 6 in which each system is provided. Thus, the systems may be widely used as connector systems in various electronic-equipment applications.

The slits 103 in the contact 101 may be replaced by concavities having dimensions similar to those of the slits 103 in the system 100.

With reference to FIGS. 18A and 18B, a connector system 110 in a tenth embodiment of the present invention will now be described.

The connector system 110 includes a contact 111 consisting of a lead portion 112, a containing portion 113 for keeping a liquid metal 115 therein and a ring-type magnet 116. The containing portion 113 has the shape of hollow cylinder having a bottom. The liquid metal 115 includes many small magnetic-material grains 114 mixed therein. The magnet 116 surrounds the containing portion 113.

The containing portion 113 and the lead portion 112 may be either in one body or in separate bodies in the contact 111. In the case where the portions 112 and 113 are separate, it is possible to use the containing portion 113 made of insulating material. In this case, the contact 111 should be constructed so that the lead portion 112 pierces the bottom of the containing portion 113 so as to come into directly contact with the liquid metal 115 present in the containing portion 113.

The construction employing the above-mentioned liquid metal 115 having the magnetic-grain 114 mixed therein and the ring-type magnet 116 causes the liquid metal 115 adhere onto the inner wall of the containing portion 113 so as to form the liquid metal 115 with a ring shape together with the hole 117 formed at the axis part of the containing portion 113 as shown in FIG. 18B.

In order to establish the electrical connection of the connection pin 4 with the contact 111, the connection pin 4 is inserted into the above hole 117. The diameter of the hole 117 may be adjusted by controlling the amount of the small grains 114 to be mixed in the liquid metal 115 so it is approximately the same as the diameter of the connection pin 4. Thus the approximate ZIF can be achieved by inserting the connection pin 4 into the contact 111.

In a construction such as that of the connector system 110, since the liquid metal 115 is held in the containing portion 113 because the magnetic grains 114 mixed in the liquid metal 115 are attracted by the ring-type magnet 116, the liquid metal 115 can be prevented from being splashed outside even if a large opening is present at the top of a containing portion, such as the portion 113.

Figure 19:
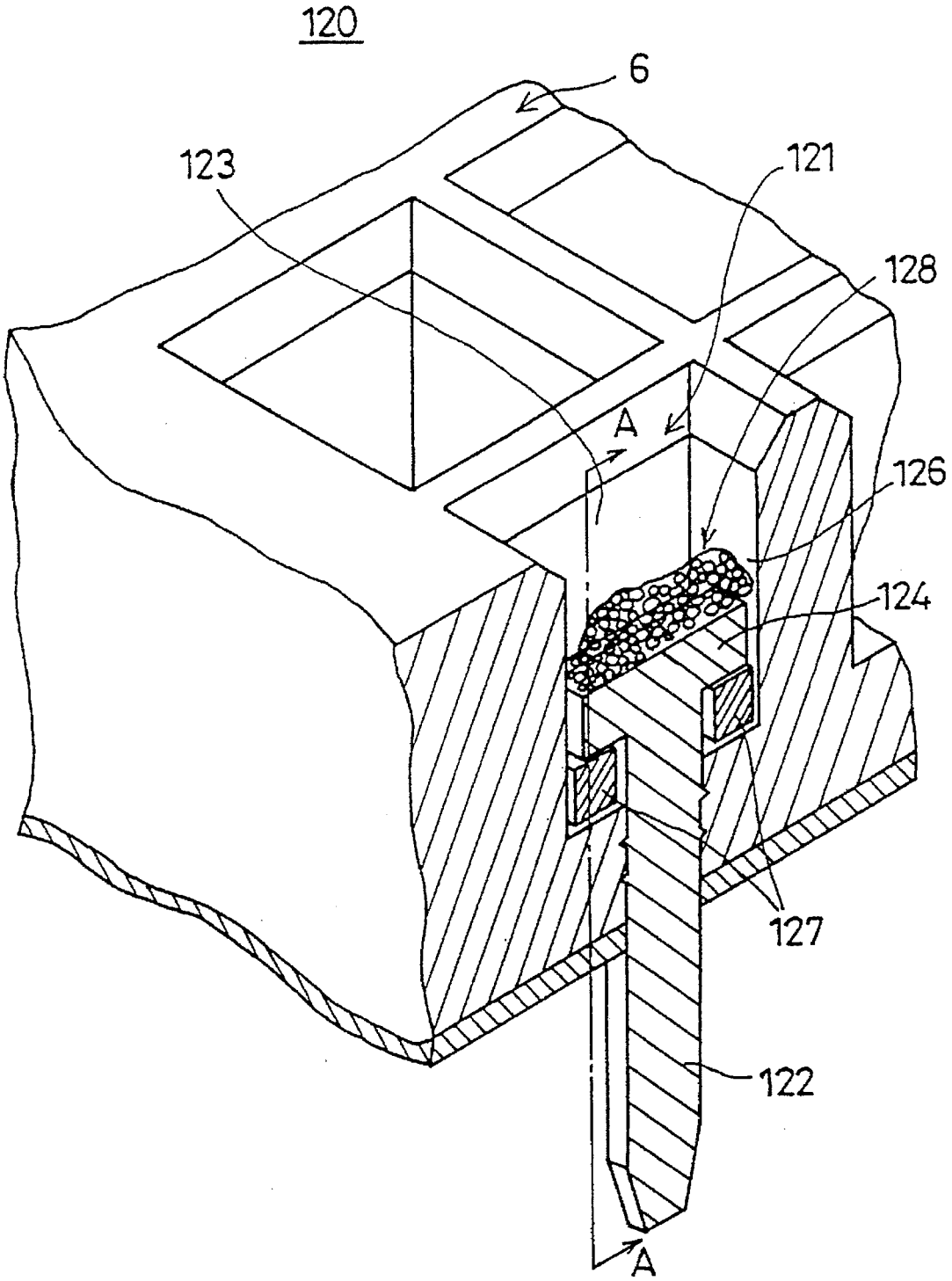
FIG. 19 shows a sectional perspective view of a connector in a eleventh embodiment of the present invention.
Figure 20:
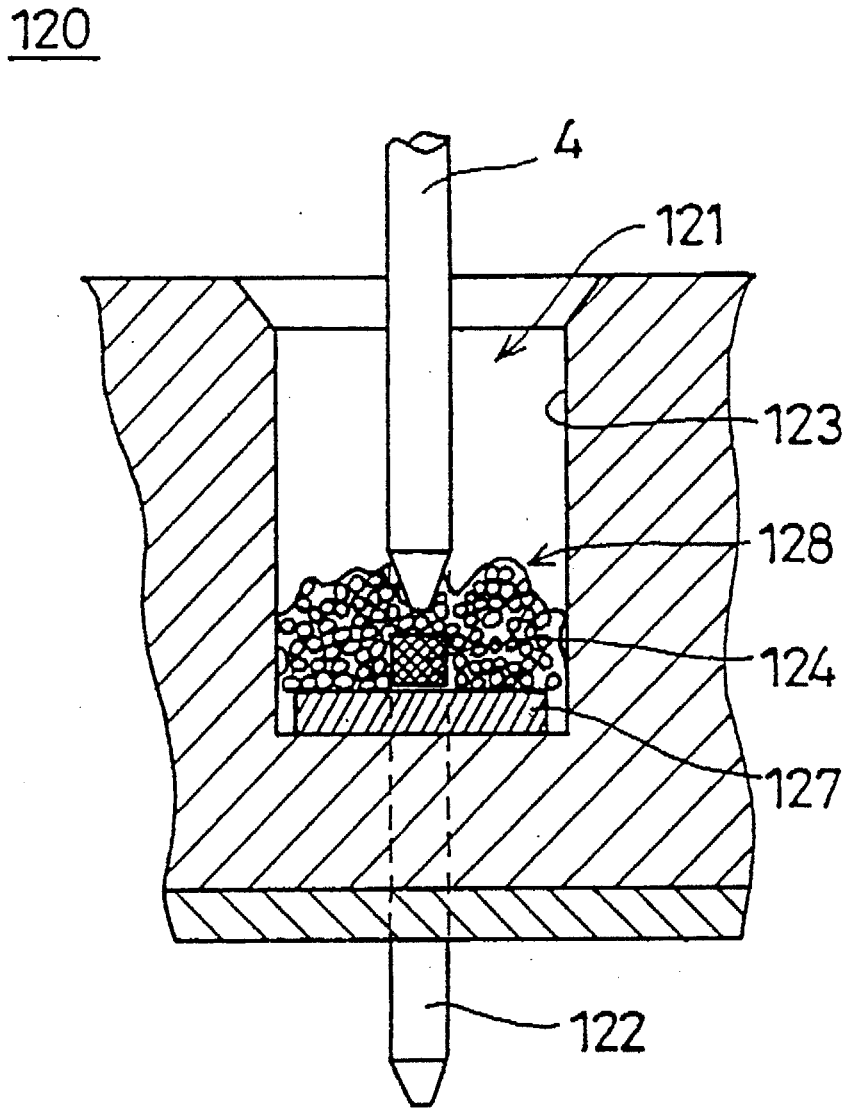
FIG. 20 shows a sectional side elevation view, taken along the line A—A of FIG. 19, of the connector shown in FIG. 19 together with a connection pin.

With reference to FIGS. 19 and 20, a connector system 120 in an eleventh embodiment of the present invention will now be described.

The connector system 120 includes a contact 121 consisting of a lead member 122 and an insertion hole 123 formed in the insulation substrate 6. The lead member 122 is insert-molded in the insulation substrate 6. The lead member 122 is approximately T-shaped and has a collar portion 124 at the top thereof. The top of the collar portion 124 defines a containing space 126 in which a liquid metal 128 in which many small grains of magnetic material are mixed is kept. Two magnets 127 are provided at the bottom of the collar portion 124.

In order to establish an electrical connection of the connection pin 4 with the contact 121, the connection pin 4 is inserted into the containing space 126 in the insertion hole 123 as shown in FIG. 20. Thus, the connection pin 4 comes into contact with the liquid metal 128 so that the electrical connection of the pin 4 with the liquid metal 128 having the electrical connection with the lead member 122 is established, the electrical connection of the connection pin 4 with the lead member 122 being thus in turn established.

Since the pin 4 is inserted into the liquid metal 128 including the mixed grains, more insertion force is required in than the case of the other connector systems in the embodiments described above. However, the amount of the insertion force is not significant one and the approximate ZIF insertion operation can be achieved. In a construction such as that of the connector system 120, since the liquid metal 128 is held in the containing space 126 because the magnetic small grains mixed in the liquid metal 128 are attracted by the magnets 127, the liquid metal 128 can be prevented from being splashed outside even if a large opening is present at the top of a containing space such as the space 126.

Further, performing the rust-prevention process on the surface of each of the small grains mixed in the liquid metal 128 can prevent the small grains from rusting so that the liquid metal 128 can be prevented from being polluted due to the rust.

Further, the present invention is not limited to the above described embodiments, and variations and modifications may be made without departing from the scope of the present invention.

What is claimed is:

1. A connector comprising:

a first contact member comprising a liquid conductor which comes into contact with a second contact member so as to establish an electric connection between the two contact members; and a container for containing said first contact member therein, wherein said container has an opening for allowing said second contact member to be inserted into said container, and wherein said container includes an outer wall with a middle portion, said middle portion being bent inwardly so said container has a diameter at said middle portion which is less than a diameter of the opening and also less than a diameter of a lower portion of said container, for preventing said liquid conductor in said container from being splashed.

2. The connector according to claim 1, wherein said middle portion comprises an inwardly curved area contraction portion.

3. The connector according to claim 1, wherein said means comprises a area contraction member installed at an approximate position in said container for contracting the cross section area of said container.

4. The connector according to claim 1, wherein said means comprises grains contained in said container together with said liquid conductor.

5. A connector comprising:

a first contact member comprising a liquid conductor which comes into contact with a second contact member so as to establish an electric connection between the two contact members; and a container for containing said first contact member therein;

and wherein:

said second contact member is pin-shaped;

said container is tube-shaped and has a containing portion which is filled with said liquid conductor, and has an opening through which said second contact member is inserted; and an area contraction portion for contracting the cross sectional area of said container formed at a position between said containing portion and said opening, said area contraction portion comprising a bent or curved portion of a wall of said container.

6. The connector according to claim 5, wherein:

said container is installed in a through hole provided in a base member and;

said container includes a pipe member of an electric conductor which comes into direct contact with said liquid conductor and a plug member to be inserted into said hole, before said pipe member is inserted, for preventing said liquid conductor from escaping said container.

7. The connector according to claim 5, wherein:

said container is installed in a hole provided in a base member;

said container is formed of elastic material;

the portion of said container near to said opening is split into segments and portions of said segments are positioned away from each other as said portions are near to said opening so that the outer diameter of said segments is larger than the inner diameter of said hole before said container is installed into said hole, said segments approaching each other as said container is inserted into said hole against the elastic force of said segments.

8. The connector according to claim 5, wherein:

said container is installed in a through hole provided in a base member; and said container is made of an electric conductor and an end of a lead is connected to said container, the other end of said lead projecting from a first surface of said base member, said first surface being opposite to a second surface at which said opening is exposed.

9. The connector according to claim 5, wherein:

said opening comprises two openings located at either end of said container and two of said second contact members being inserted into said container through said two openings so that an electric connection may thus be established between two of said second contact members through said liquid conductor contained in said container; and said area contraction portion comprises two area contraction portions provided for said two openings.

10. The connector according to claim 5, wherein:

said container is made of electrically conductive material; and said container is installed in a through hole provided in a base member, a land made of electrically conductive material being provided inside said hole so that an electric connection may be established between said container and said land when said container is installed in said hole.

11. The connector according to claim 5, wherein:

either said liquid conductor comprises a liquid metal having magnetic properties or magnetic material is mixed with said liquid conductor; and a magnet is provided adjacent to said container.

12. A connector system comprising:

a first contact member comprising a liquid conductor which comes into contact with a second contact member so as to establish the electric connection between the two contact members;

a container for containing said first contact member therein; and said second contact member;

and wherein said container has an opening for allowing said second contact member to be inserted into said container, and wherein said container includes an outer wall with a middle portion, said middle portion being bent inwardly so said container has a diameter at said middle portion which is less than a diameter of the opening and also less than a diameter of a lower portion of said container for preventing said liquid conductor in said container from being splashed.

13. The connector system according to claim 12, wherein:

said second contact member is pin-shaped;

said container is tube-shaped and has a containing portion which is filled with said liquid conductor.

14. The connector system according to claim 13, wherein said second contact member comprises a contact pin formed on an integrated circuit device.

15. The connector system according to claim 12, wherein:

said second contact member is pin-shaped;

said container is tube-shaped and has a containing portion, which is filled with said liquid conductor, and has an opening through which said second contact member is inserted; and an area contraction member provided at said opening for contracting the cross sectional area of said container.

16. The connector system according to claim 12, wherein said container is either a concavity or a through hole provided in a base member.

17. The connector system according to claim 12, wherein:

said second contact member is pin-shaped;

grains are mixed with said liquid conductor; and the container has an opening at an end thereof, through which opening said second contact member is inserted into said container, and a lead is formed on the other end of said container.

18. The connector system according to claim 12, wherein:

said second contact member is pin-shaped;

grains are mixed with said liquid conductor; and the container has an opening at an end thereof, through which opening said second contact member is inserted into said container, and a lead is supported on the other end of said container.

19. A connector assembly comprising:

an insulating plate; and plurality of connectors provided in said insulating plate;

and wherein each connector of said plurality of connectors comprises:

a first contact member comprising a liquid conductor which comes into contact with a second contact member so as to establish the electric connection between the two contact members; and a container for containing said first contact member therein said container including an opening for allowing said second contact member to be inserted into said container, and wherein said container includes an outer wall with a middle portion, said middle portion being bent inwardly so said container has a diameter at said middle portion which is less than a diameter of the opening and also less than a diameter of a lower portion of said container, for preventing said liquid conductor in said container from being splashed; and wherein said connector assembly is formed so that the first contact members contained in said plurality of connectors are prevented from coming into contact with one another.

20. The connector assembly according to claim 19, wherein:

said second contact member is pin-shaped;

said container is tube-shaped and has a containing portion, which is filled with said liquid conductor.

21. The connector assembly according to claim 19, wherein:

said second contact member is pin-shaped;

said container is tube-shaped and has a containing portion, which is filled with said liquid conductor, and has an opening through which said second contact member is inserted; and an area contraction member provided at said opening for contracting the cross sectional area of said container.

22. The connector assembly according to claim 19, wherein said container is either a concavity or a through hole provided in said insulating plate.

23. The connector assembly according to claim 19, wherein:

said second contact member is pin-shaped;

grains are mixed with said liquid conductor; and the container has an opening at an end thereof, through which opening said second contact member is inserted into said container, and a lead is formed on the other end of said container.

24. The connector assembly according to claim 19, wherein:

said second contact member is pin-shaped;

grains are mixed with said liquid conductor; and the container has an opening at an end thereof, through which opening said second contact member is inserted into said container, and a lead is supported on the other end of said container.

* * * * *